US005638033A

United States Patent [19]

Walker et al.

[11] Patent Number: 5,638,033

[45] Date of Patent: Jun. 10, 1997

[54] THREE PORT SLOT LINE CIRCULATOR

[75] Inventors: Lonny R. Walker, Torrance; Clifton Quan, Arcadia, both of Calif.

[73] Assignee: Hughes Electronics, Los Angeles, Calif.

[21] Appl. No.: 579,276

[22] Filed: Dec. 27, 1995

[51] Int. Cl.[6] ..... H01P 1/383

[52] U.S. Cl. ..... 333/1.1; 343/767

[58] Field of Search ..... 333/1.1; 343/767, 343/770

[56] References Cited

U.S. PATENT DOCUMENTS 3,594,664 7/1971 Lipetz ..... 333/1.1

4,027,253 5/1977 Chiron et al. ..... 333/1.1

5,153,538 10/1992 Kane ..... 333/1.1 X 5,264,860 11/1993 Quan ..... 343/767

*Primary Examiner*—Paul Gensler

*Attorney, Agent, or Firm*—Leonard A. Alkov; Wanda K. Denson-Low

[57] ABSTRACT

A three port microwave circulator in a slot line transmission medium. Two slot lines are formed which extend from two ports of the circulator in a collinear alignment through a coupler region, and are joined at a power combining junction to provide a single transmission line to the third port of the circulator. A ferrite slab overlays the coupler region. The ferrite is saturated with a static magnetic field, applied by a magnet, along a direction of signal propagation. The circulator can be integrated into a flared notch radiator element to provide separate transmit and receive ports.

15 Claims, 5 Drawing Sheets

THREE PORT SLOT LINE CIRCULATOR

TECHNICAL FIELD OF THE INVENTION

This invention relates to the RF device field, and more particularly to a three port slot line circulator operating at microwave frequencies.

BACKGROUND OF THE INVENTION

One purpose of this invention is to provide a microwave circulator suitable for use in flared notch antenna apertures. Currently, microstrip circulators are embedded within the flared notch housing to isolate antenna components. Suspended strip line is used to transition from microstrip to the slot line flared notch requiring three separate transmission media. For example, active array antennas utilize flared notch apertures with embedded microstrip circulators to isolate the T/R module. The low observable performance is currently limited by the existing circulator and aperture assembly tolerances.

In current designs, deviations from the manufacturing tolerances of the circulators and the aperture assembly limit the LO performance. Each transition is a source of scattering and inconsistency, both of which impact radar cross section (RCS) performance.

SUMMARY OF THE INVENTION

A three port slot line circulator operable at microwave frequencies in accordance with one aspect of the invention comprises first and second slot line transmission lines segments, the first slot line segment having a first end connected to a first port, the second slot line segment having a first end connected to the second port. The first and second lines segments are arranged in a contiguous alignment in a coupler region to form a transmission line coupler. The first and second lines extend through the coupler region to a power combiner segment at which the first and second segments join together to form a third slot line transmission line segment. The third line segment has a first end connected at the power combiner segment and a second end connected to a third circulator port.

The circulator further includes a ferrite slab member overlaying the first and second line segments in the coupler region, and a magnet arranged in relation to the ferrite slab member so as to saturate the slab member with a static magnetic field along a direction of signal propagation through the coupler region.

In accordance with another aspect of the invention, a flared notch radiator element has a circulator incorporated therein, and includes an electrically conductive flared notch element defining a thick slot line transmission line in a flared notch which transitions to first and second thick slot line transmission line segments. A ferrite member overlays the first and second line segments at a circulator region. A magnet is arranged in relation to the ferrite member so as to saturate the ferrite member with a static magnetic field. The ferrite and magnet provide a circulator which electrically isolates the first and second line segments from each other, while permitting microwave signals to propagate from the first line segment to the thick slot line transmission line, and while permitting microwave signals to propagate from the thick slot line transmission line to the second line segment.

A flared notch radiator element with a circulator incorporated therein in accordance with an aspect of the invention uses one transmission media throughout the aperture which reduces the number of scatters, eliminates solder joints, and simplifies the assembly. This will improve the manufacturing consistency by reducing part count and scattering sources, which will improve the antenna RCS performance. It also has the potential to reduce cost since the part count is reduced.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

This invention provides a non-reciprocal three port circulator in slot line transmission media. By utilizing coupled slot line modes in a ferrite region with a static magnetic field, three port circulator functions are achieved in thin or thick slot line.

Figure 1:
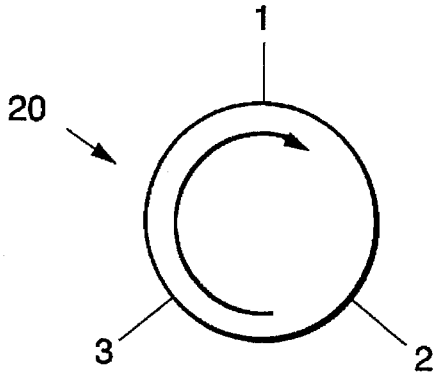
FIG. 1 illustrates an ideal three port circulator.

FIG. 1 shows an ideal microwave three port circulator 20. This circulator provides the following functionality. When microwave energy is incident on port 1 as the input port, this energy is transmitted to port 2 as the output port. Port 3 is the isolated port, and no energy is transmitted from port 1 to port 3. When port 2 is the input port, port 3 is the output port, and port 1 is the isolated port. When port 3 is the input port, port 1 is the output port, and port 2 is the isolated port.

In accordance with this invention, coupled slot line transmission line is used in the circulator, with a slab of ferrite placed over the coupled line region. When energy is coupled into the ferrite slab, non-reciprocal transmission is realized which is utilized to generate the ideal circulator functions described with respect to FIG. 1. The ferrite is magnetized in the longitudinal direction with a static magnetic field using a permanent magnet or a solenoid energized with a electric current.

Figure 2A:
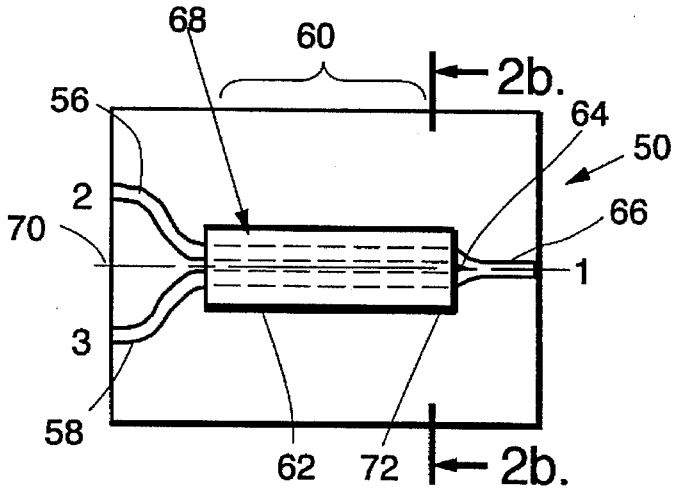
FIG. 2*a* is a top view of a thin slot line three port circulator in accordance with the invention.
Figure 2B:
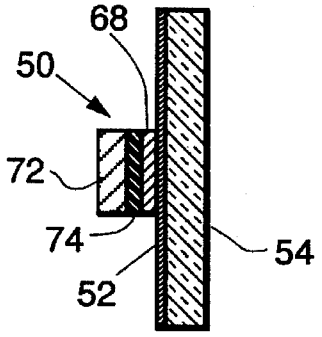
FIG. 2*b* is a side view of the thin slot line circulator taken along line 2*b*—2*b* of FIG. 2*a*.

FIGS. 2*a* and 2*b* show an exemplary embodiment of the invention, wherein a three port circulator 50 is fabricated in thin slot line etched from a copper layer 52 formed on a dielectric substrate 54. Individual slot lines 56 and 58 from ports 2 and 3 are collinear to each other in a coupled line region 60 to form a transmission line coupler 62. A simple power combiner 64 is used to join the coupled lines 56 and 58 into a single thin slot line 66, and provide a single transmission at port 1.

A ferrite slab 68 is placed over the coupled line region 60 and weakly couples to the slot line modes. The ferrite slab 68 is magnetized in a longitudinal direction along axis 70, i.e. along a direction of energy propagation, with a static magnetic field by a permanent magnet 72 disposed over the ferrite slab. A dielectric spacer 74 is disposed between the magnet 72 and the ferrite slab 68 to control the magnetic field which penetrates the ferrite in a conventional manner. By saturating the ferrite with a static magnetic field along axis 70, the device operates as a microwave circulator. If the magnetic field is reversed by reversing the magnet, the direction of circulation will rotate 180°.

Figure 3A:
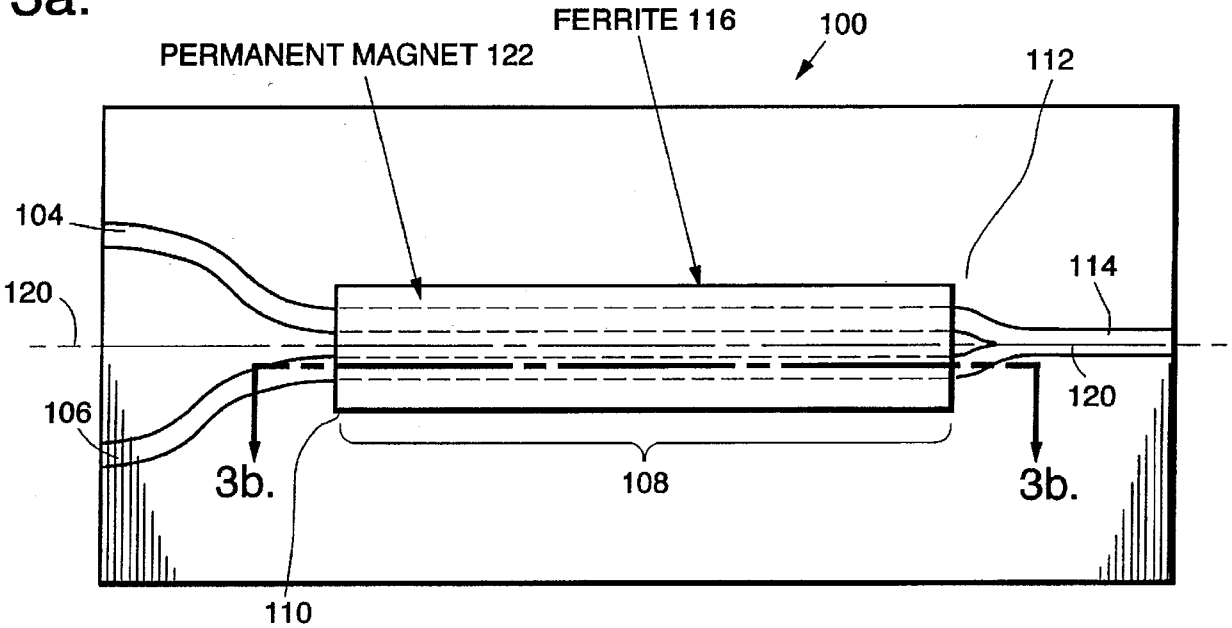
FIG. 3*a* is a top view of a thick slot line three port circulator in accordance with the invention.
Figure 3B:
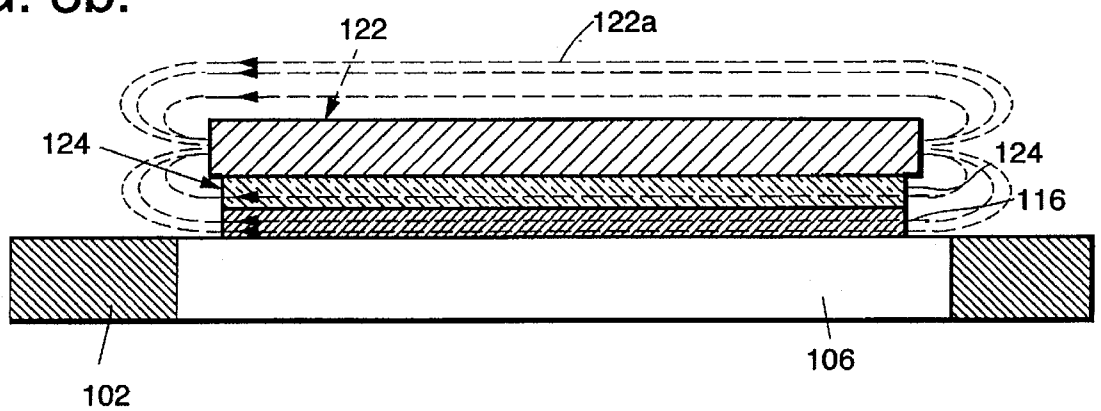
FIG. 3*b* is a side cross-sectional view of the thick slot line circulator taken along line 3*b*—3*b* of FIG. 3*a*.

FIGS. 3*a* and 3*b* show a thick slot line embodiment of a circulator 100 in accordance with the invention, where the slot line transmission line is machined from a metal housing 102; for example, housing 102 may be fabricated of aluminum. Thus, slot line 104 connects to port 2, and slot line 106 connects to port 3. Slot lines 104 and 106 from ports 2 and 3 are collinear to each other in a coupled line region 108 to form a transmission line coupler 110. A simple power combiner 112 joins the coupled lines 104 and 106 into a single thick slot line 114, and provide a single transmission at port 1.

A ferrite slab 116 is placed over the coupled line region 108, and weakly couples to the slot line modes. The ferrite slab 116 is magnetized in the longitudinal direction along axis 120, i.e. along a direction of energy propagation, with a static magnetic field by a permanent magnet 122 disposed over the ferrite slab. A dielectric spacer 124 is disposed between the magnet 122 and the ferrite slab 116 to control the magnetic field which penetrates the ferrite. By saturating the ferrite with a static magnetic field along a direction of propagation, i.e. along axis 120, the device operates as a microwave circulator. The cross-sectional view of FIG. 3*b* illustrates the magnetic field as phantom lines 122*a*.

The operation of device 100 is the same as the thin slot line circulator 50 of FIGS. 2*a*–2*b*. This configuration has the advantage of using the same slot line medium as the flared notch radiator in use for active and phased array apertures.

Figure 4A:
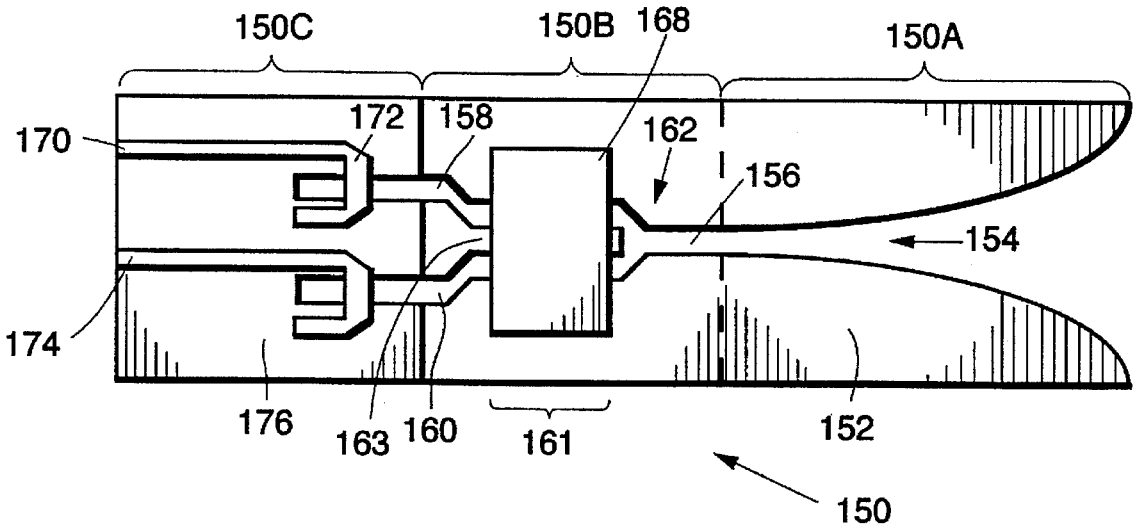
FIG. 4*a* is a top view of a flared notch radiator element incorporating a circulator in accordance with the invention.
Figure 4B:
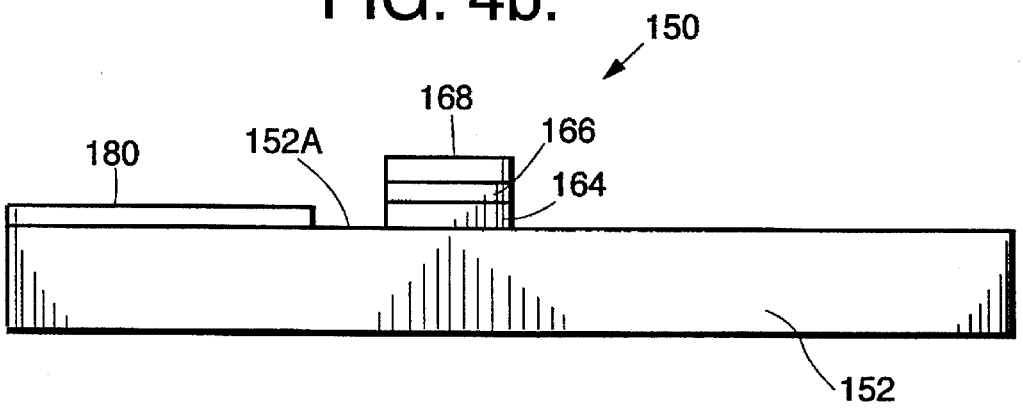
FIG. 4*b* is a side view of the radiator element of FIG. 4*a*.

FIGS. 4*a* and 4*b* illustrate a first exemplary embodiment of a flared notch radiator element 150 incorporating a three port circulator in accordance with the invention. The radiating element is characterized by three segments, a radiator section 150A, a circulator section 150B and a slotline-to-strip transmission line transition section 150C. The element 150 includes a thick aluminum housing element 152 which defines the flared notch 154 and thick slot line transmission line 156. Instead of terminating the transmission line 156 at the notch, the housing includes relieved areas or channels 158 and 160 formed through the thickness of the housing element and which define a center element 163. The channels 158 and 160 define thick slot line transmission line segments which run in parallel in coupler region 161, and then join together with the transmission line 156 to form a thick slot line transmission line power divider/combiner 162.

The flared notch element 150 further includes a ferrite slab substrate 164 which is secured to the housing element 152 over the area of the combiner 162. A dielectric spacer 166 separates a permanent magnet 168 from the ferrite slab 164. The ferrite substrate 164, spacer 166 and magnet 168 can be bonded together and to the surface 152A of the housing 152 by epoxy or other fastening methods, The coupler 161 and combiner 162 in combination with the ferrite 164 and magnet 168 form a circulator in thick slot line transmission line.

The flared notch element 150 further includes the strip transmission line-to-slotline transmission line transition section 150C. In section 150C, strip conductor transmission lines 170 and 174 are defined on dielectric substrate 180, each forming a respective balun 172 and 176 which overlays a respective slot line 158 and 160. The baluns provide a circuit for coupling into and from the slotlines from the strip transmission lines. The dielectric substrate 180 is bonded to the surface of the housing 152. The strip conductors can then be connected to coaxial connectors (not shown) to provide a means for making electrically connections to the slot line transmission lines.

Figure 5A:
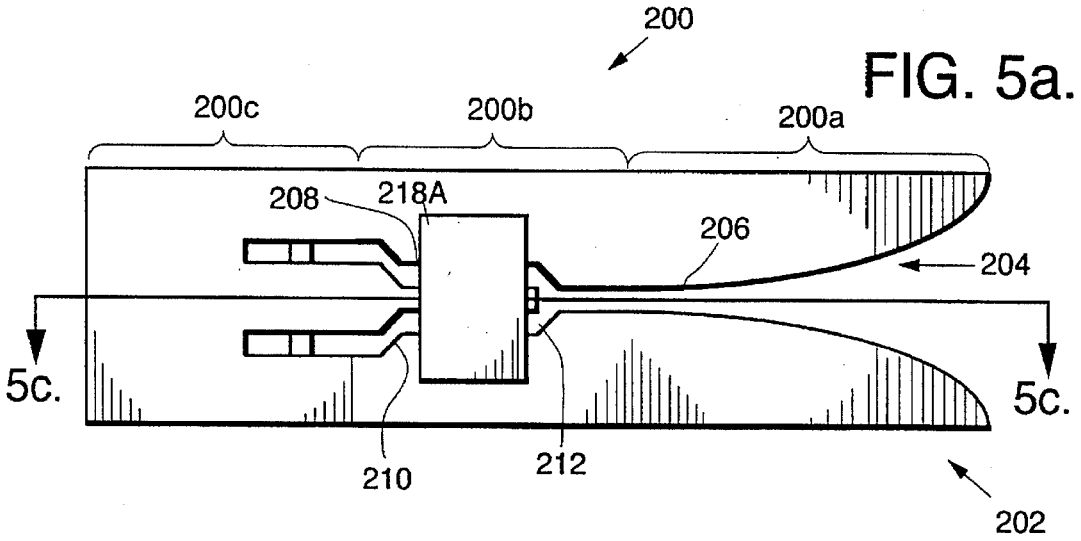
FIGS. 5*a*–*d* illustrate a first alternate embodiment of a flared notch radiator element incorporating a circulator in accordance with the invention.
Figure 5B:
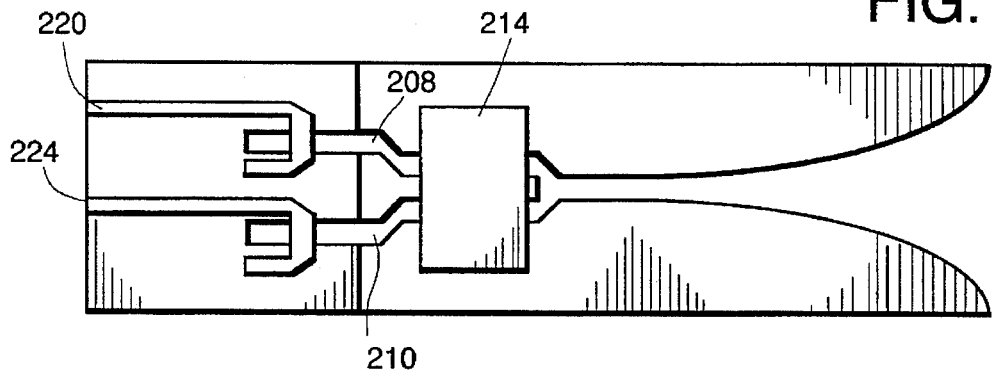
Figure 5C:
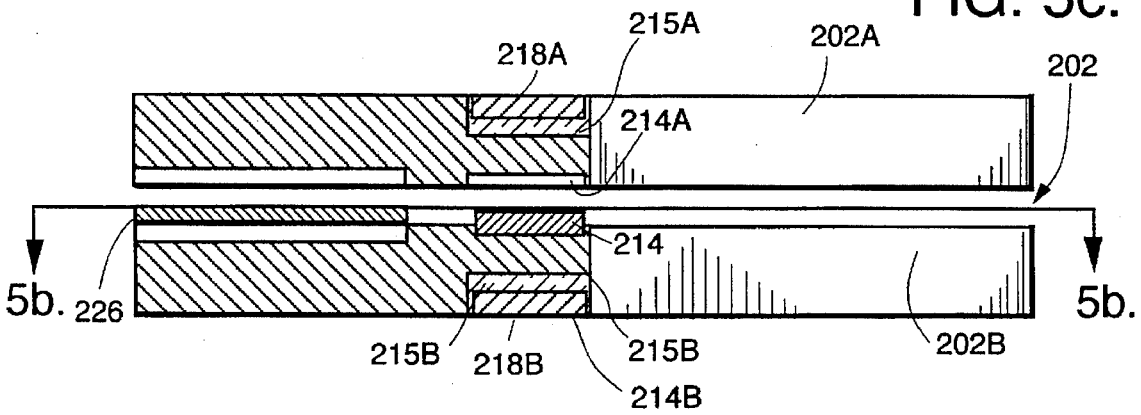
Figure 5D:
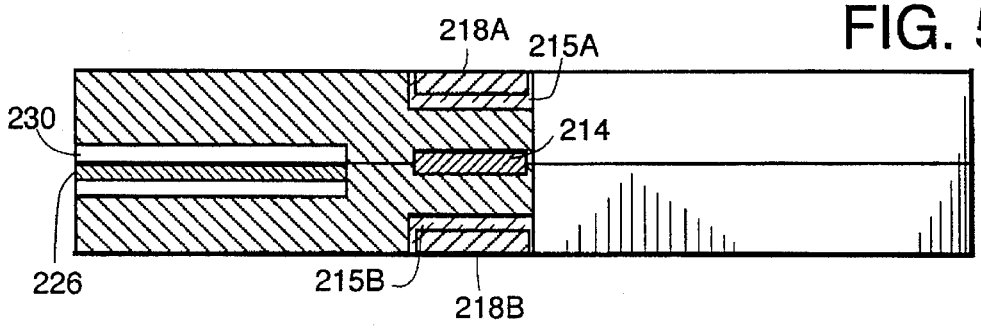

FIGS. 5*a*–5*d* illustrate a second embodiment of a flared notch radiator 200 having a circulator in accordance with the invention incorporated therein. This embodiment also includes a radiator section 200A, a circulator section 200B and a slotline-to-stripline transmission line transition Section 200C. As shown in the cross-section views of FIGS. 5*c* and 5*d*, the housing structure 202 is formed as upper and lower half sections 202A and 202B; FIG. 5*c* shows the two half sections in a separated relationship; FIG. 5*d* shows the two half sections in an assembled relationship. FIG. 5*b* is a top view with the top half section 202A removed to expose the ferrite slab and strip transmission line circuits formed on the dielectric substrate.

The radiator element 200 includes a flared notch 204 and a thick slotline transmission line 206, which joins with slotline transmission line segments 208 and 210 at combiner 212. A ferrite substrate 214 is embedded between the two housing sections 202A and 202B in respective recesses 214A and 214B defined in the housing sections. Dielectric spacers 215A and 215B fit into externally facing recesses formed in the exterior housing section surfaces, to form a dielectric shield between the aluminum housing sections and magnets 218A and 218B.

The dielectric substrate 226 carries strip conductors 220 and 224, as in the embodiment of FIG. 4, but is embedded between the two housing sections 202A and 202B in an open channel region 230.

Figure 6A:
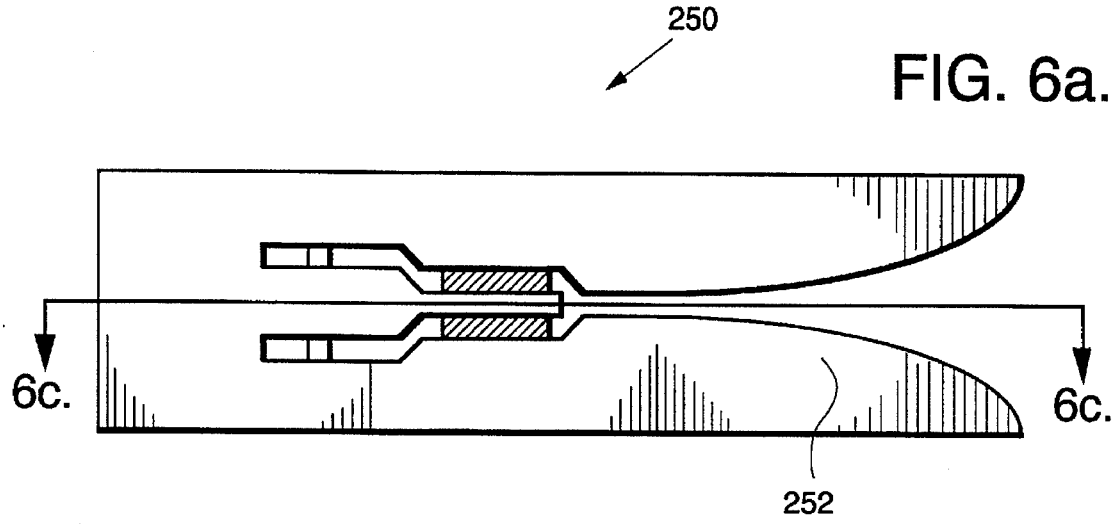
FIGS. 6*a*–6*c* illustrate a second alternate embodiment of a flared notch radiator element incorporating a circulator in accordance with the invention.
Figure 6B:
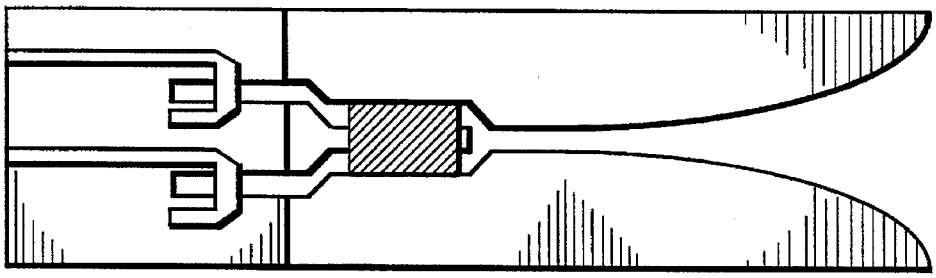
Figure 6C:
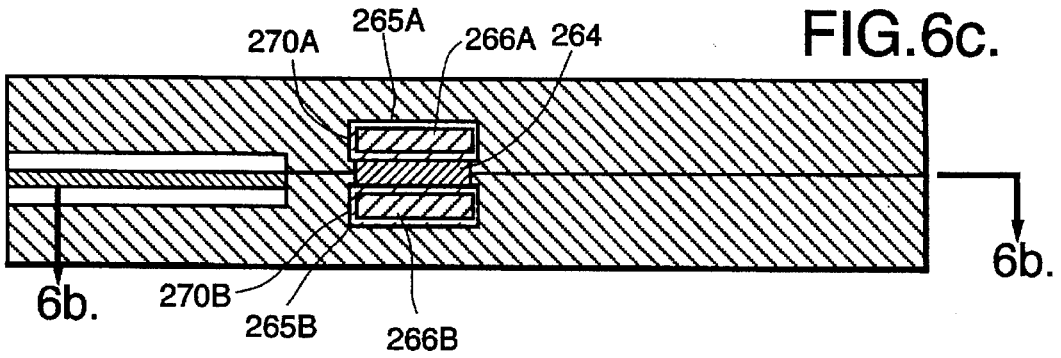

FIGS. 6*a*–6*c* show a third embodiment of a flared notch radiator 250 incorporating a circulator in accordance with the invention. In this embodiment, the ferrite substrate 264, dielectric spacers 265A, 265B and magnets 266A, 266B are all embedded within the sandwiched housing structure 252, as illustrated in the cross-sectional view of FIG. 6*c*. The spacers 265A and 265B completely enclose a respective magnet 266A and 266B. Each housing half section includes a recess 270A, 270B into which the ferrite substrate, dielectric spacers and magnets fit. The strip transmission line balun circuits are identical to those described above regarding the embodiment of FIGS. 5*a*–5*d*.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A three port slot line circulator operable at microwave frequencies, comprising:

first, second and third ports;

first and second slot line transmission line segments, said first slot line segment having a first end connected to said first port, said second slot line segment having a first end connected to said second port, said first and second line segments arranged in a contiguous alignment in a coupler region to form a transmission line coupler, said first and second line segments extending through said coupler region to a power combiner segment at which said first and second segments join together to form a third slot line transmission line segment, said third line segment having a first end connected at said power combiner segment and a second end connected to said third port;

a ferrite slab member overlaying said first and second line segments in said coupler region; and a permanent magnet for producing a magnetic field, said permanent magnet arranged in relation to said ferrite slab member so as to saturate said slab member with a static magnetic field along a direction of signal propagation through the coupler region.

2. The circulator of claim 1 wherein said ferrite slab member is disposed between said permanent magnet and said slot line coupler region.

3. The circulator of claim 2 further comprising a dielectric spacer disposed between said permanent magnet and said ferrite slab member.

4. A flared notch radiator element having a circulator incorporated therein, comprising:

an electrically conductive flared notch element defining a thick slot line transmission line in a flared notch which transitions to first and second thick slot line transmission line segments arranged in a substantially parallel arrangement in a coupler region;

a ferrite member overlaying said first and second line segments in said coupler region; and a magnetic means for producing a magnetic field, the magnetic means arranged in relation to the ferrite member so as to saturate the ferrite member with a static magnetic field;

the ferrite members and magnetic means providing a circulator which electrically isolates the first and second line segments from each other, while permitting microwave signals to propagate from the first line segment to the thick slot line transmission line, and while permitting microwave signals to propagate from the thick slot line transmission line to the second line segment.

5. A three port slot line circulator operable at microwave frequencies, comprising:

first, second and third ports;

first and second slot line transmission line segments, said first slot line segment having a first end connected to said first port, said second slot line segment having a first end connected to said second port, said first and second line segments arranged in a contiguous alignment in a coupler region to form a transmission line coupler, said first and second line segments extending through said coupler region to a power combiner segment at which said first and second segments join together to form a third slot line transmission line segment, said third line segment having a first end connected at said power combiner segment and a second end connected to said third port, wherein said first, second and third slot line transmission line segments are thin slot line segments, defined by slot line patterns defined in a thin conductive layer formed on a surface of a dielectric substrate;

a ferrite slab member overlaying said first and second line segments in said coupler region; and a permanent magnet for producing a magnetic field, said permanent magnet arranged in relation to said ferrite slab member so as to saturate said slab member with a static magnetic field along a direction of signal propagation through the coupler region.

6. The circulator of claim 5 wherein said ferrite slab member is disposed between said permanent magnet and said slot line coupler region.

7. The circulator of claim 6 further comprising a dielectric spacer disposed between said permanent magnet and said ferrite slab member.

8. A three port slot line circulator operable at microwave frequencies, comprising:

first, second and third ports;

first and second slot line transmission line segments, said first slot line segment having a first end connected to said first port, said second slot line segment having a first end connected to said second port, said first and second line segments arranged in a contiguous alignment in a coupler region to form a transmission line coupler, said first and second line segments extending through said coupler region to a power combiner segment at which said first and second segments join together to form a third slot line transmission line segment, said third line segment having a first end connected at said power combiner segment and a second end connected to said third port, wherein said first, second and third slot line transmission line segments are thick slot line segments, defined by slot line patterns defined in a thick layer of conductive material;

a ferrite slab member overlaying said first and second line segments in said coupler region; and a magnet means for producing a magnetic field, said magnet means arranged in relation to said ferrite slab member so as to saturate said slab member with a static magnetic field along a direction of signal propagation through the coupler region.

9. The circulator of claim 8 wherein said magnet means is a permanent magnet.

10. The circulator of claim 9 further comprising a dielectric spacer disposed between said permanent magnet and said ferrite slab member.

11. A flared notch radiator element having a circulator incorporated therein, comprising:

an electrically conductive flared notch element defining a thick slot line transmission line in a flared notch which transitions to first and second thick slot line transmission line segments arranged in a coupler region;

a ferrite member overlaying said first and second line segments in said coupler region;

a magnetic means for producing a magnetic field, the magnetic means arranged in relation to the ferrite member so as to saturate the ferrite member with a static magnetic field; and a dielectric substrate having formed thereon first and second strip transmission line conductor strips, an end of the first conductor strip arranged to define a first balun overlaying the first line segment, an end of the second conductor strip arranged to define a second balun overlaying the second line segment;

the ferrite member and magnetic means providing a circulator which electrically isolates the first and second line segments from each other, while permitting microwave signals to propagate from the first line segment to the thick slot line transmission line, and while permitting microwave signals to propagate from the thick slot line transmission line to the second line segment.

12. A flared notch radiator element having a circulator incorporated therein, comprising:

an electrically conductive flared notch element, having a first exterior surface, defining a thick slot line transmission line in a flared notch which transitions to first and second thick slot line transmission line segments arranged in a coupler region;

a ferrite slab attached to said first exterior surface of said electrically conductive flared notch element, overlaying said first and second line segments in said coupler region;

a magnetic means for producing a magnetic field, the magnetic means arranged in relation to the ferrite slab so as to saturate the ferrite slab with a static magnetic field; and a dielectric spacer element disposed between said ferrite slab and a magnet element comprising said magnet means.

the ferrite slab and magnet element providing a circulator which electrically isolates the first and second line segments from each other, while permitting microwave signals to propagate from the first line segment to the thick slot line transmission line, and while permitting microwave signals to propagate from the thick slot line transmission line to the second line segment.

13. A flared notch radiator element having a circulator incorporated therein, comprising:

an electrically conductive flared notch element, comprising upper and lower half section elements which sandwich a ferrite member, defining a thick slot line transmission line in a flared notch which transitions to first and second thick slot line transmission line segments arranged in a coupler region;

said ferrite member overlaying said first and second line segments in said coupler region;

a magnetic means, including first and second magnets received in respective first and second recesses formed in respective exterior surfaces of said upper and lower half section elements, for producing a magnetic field, the magnetic means arranged in relation to the ferrite member so as to saturate the ferrite member with a static magnetic field; and first and second dielectric spacer elements disposed respectively in the first and second recesses and separating the first and second magnets from the upper and lower half section elements;

the ferrite member and magnetic means providing a circulator which electrically isolates the first and second line segments from each other, while permitting microwave signals to propagate from the first line segment to the thick slot line transmission line, and while permitting microwave signals to propagate from the thick slot line transmission line to the second line segment.

14. The radiator element of claim 13 further including a dielectric substrate having formed thereon first and second strip transmission line conductor strips, an end of the first conductor strip arranged to define a first balun overlaying the first line segment, an end of the second conductor strip arranged to define a second balun overlaying the second line segment, and wherein the baluns provide transitions from thick slot line to strip transmission line.

15. A flared notch radiator element having a circulator incorporated therein, comprising:

an electrically conductive flared notch element, comprising upper and lower half section elements which sandwich a ferrite member, defining a thick slot line transmission line in a flared notch which transitions to first and second thick slot line transmission line segments arranged in a coupler region;

a ferrite member overlaying said first and second line segments in said coupler region;

a magnetic means, including first and second magnets received in respective first and second recesses formed in respective interior surfaces of said upper and lower half section elements, for producing a magnetic field, the magnetic means arranged in relation to the ferrite member so as to saturate the ferrite member with a static magnetic field; and said radiator element further comprising first and second dielectric spacer elements disposed respectively in the first and second recesses and separating the first and second magnets from the upper and lower half section elements and from the ferrite member;

the ferrite member and magnetic means providing a circulator which electrically isolates the first and second line segments from each other, while permitting microwave signals to propagate from the first line segment to the thick slot line transmission line, and while permitting microwave signals to propagate from the thick slot line transmission line to the second line segment.

* * * * *